US008202148B2

(12) United States Patent
Young

(10) Patent No.: US 8,202,148 B2
(45) Date of Patent: Jun. 19, 2012

(54) MACHINE AND METHOD FOR CADDYING AND GOLF INSTRUCTION

(76) Inventor: Julius Young, Osprey, FL (US)

( * ) Notice: Subject to any disclaimer, the term of this patent is extended or adjusted under 35 U.S.C. 154(b) by 1174 days.

(21) Appl. No.: 11/949,765

(22) Filed: Dec. 3, 2007

(65) Prior Publication Data

US 2009/0143882 A1 Jun. 4, 2009

(51) Int. Cl.
*A63F 9/24* (2006.01)
*A63B 69/36* (2006.01)
*A63B 57/00* (2006.01)

(52) U.S. Cl. ..... 463/3; 473/131; 473/407

(58) Field of Classification Search ..... 463/3; 473/131, 473/165, 190, 201, 207, 218, 219, 221, 223, 473/226, 266, 282, 351, 407; 434/252
See application file for complete search history.

(56) References Cited

U.S. PATENT DOCUMENTS

| | | | | |
|---|---|---|---|---|
| 5,372,365 | A * | 12/1994 | McTeigue et al. | 473/409 |
| 5,655,223 | A * | 8/1997 | Cozza | 2/161.2 |
| 6,151,563 | A * | 11/2000 | Marinelli | 702/141 |
| 6,408,545 | B1 * | 6/2002 | Song | 36/127 |
| 6,456,938 | B1 * | 9/2002 | Barnard | 701/213 |
| 7,118,498 | B2 * | 10/2006 | Meadows et al. | 473/407 |
| 7,736,242 | B2 * | 6/2010 | Stites et al. | 473/221 |

* cited by examiner

*Primary Examiner* — David L Lewis
*Assistant Examiner* — Robert Mosser
(74) *Attorney, Agent, or Firm* — Young Farr Gamels & Young Patent Consulting; Julius Young

(57) ABSTRACT

The present invention relates to a machine and method used to capture, analyze, score, archive, track and communicate real-time relevant golf data specific to individual golfers: 1) during practice/lessons; or 2) for every shot on every hole of an entire recreational golf round; and 3) archive all such practice sessions or rounds during which the invention is in use. Additionally it could be used to support a foursome or an entire tournament for those participants using the invention.

17 Claims, 1 Drawing Sheet

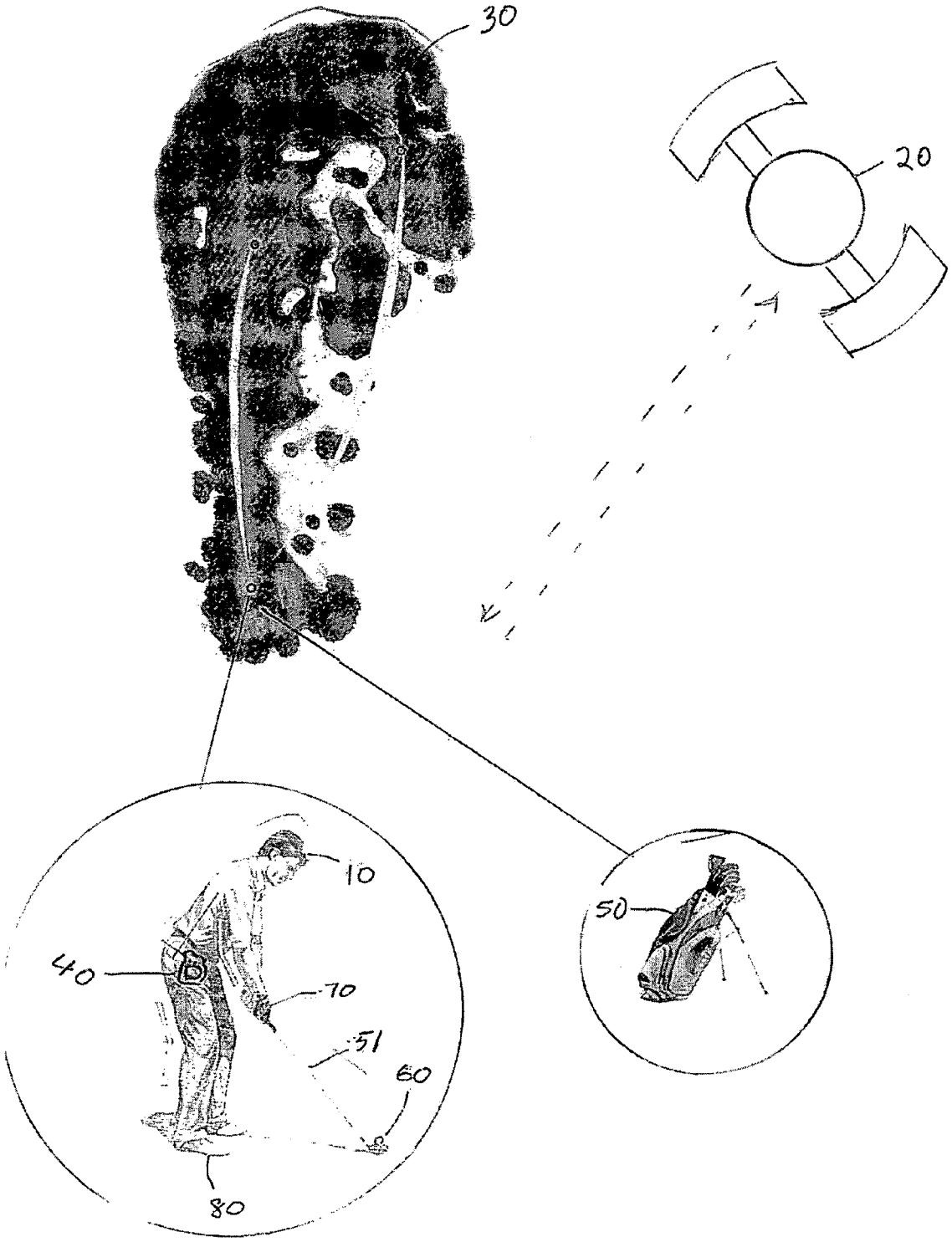
30
20
10
40
70
51
60
80
50

MACHINE AND METHOD FOR CADDYING AND GOLF INSTRUCTION

FIELD OF THE INVENTION

The present invention relates to a machine and method used to capture, analyze, score (i.e. using USGA rules), archive, track and communicate (verbal and/or display) real-time relevant golf data specific to individual golfers: 1) during practice/lessons; or 2) for every shot on every hole of an entire recreational golf round; and 3) archive all such practice sessions or rounds during which the invention is in use. Additionally it could be used to support a foursome or an entire tournament for those participants using the invention.

BACKGROUND OF THE INVENTION

The prior art contains literature, machines and processes that provide incomplete but relevant developments in some of the same technological areas as those necessary to fully implement the present invention.

These fall roughly into two categories. The first category relates to literature, machines and processes that provide real-time professional golf tournament and player information for the use and entertainment of golf enthusiast (i.e. spectators) and/or PGA Tour Professional Golfers but do not provide any such information for the average golfer.

For example, "TOURCast"™ is an online service for fans, available on PGATOUR.COM, which gives fans access to real-time tournament and player information at the click of a mouse. It uses a data collection and management solution called "ShotLink,"™ which provides real-time scoring information for PGA TOUR events. To put this complex ShotLink™ system in place, each course the TOUR plays was mapped. Using Global Positioning System (GPS) devices, different layers and elevations were recorded to denote the greens, fairways, bunkers, water, rough, trees and other course elements. During tournament play, walking scorers accompany each player pairing and use wireless handheld devices to record and transmit data (via satellite), including distance, lie, location and score, from every hole, for each player.

To supplement this data, several spotters operate sophisticated laser devices positioned at points along the fairway and on the green of each hole throughout the course to manually record the exact position of every ball. ShotLink™ represents a complete source of information for onsite event spectators. It is the data engine behind the tournaments, capturing every point, for every golfer, on every hole. This information is sent to the ShotLink™ trailer on site, as well as the laser operator volunteers. In addition, another key component, "TournamentTracker"™ is the front-end application that delivers real-time ShotLink™ content to the media, broadcasters and spectators at the event site using notebook computers.

This system uses very high tech machines and processes, it is also a very labor intensive process—requiring as many as 250 volunteers plus staff per Tour Event and approximately 10,000 volunteers to support 102 Tour Events a year, each of which could have a field of more than 100 players competing simultaneously on a 450-acre field; and it takes four days to play.

In light of these extensive support requirements, the use of such machines and processes as described above for the average golfer's round is impractical. Therefore there is a need for a fully automated more cost effective machine and method for providing real-time relevant golf data specific to the average golfer when practicing or taking lessons to become a better golfer or to increase the enjoyment of playing a recreational round of golf.

As for machines and processes that fall into the second category, these relate to machines and processes that offer diverse solutions to narrow segments of the spectrum of what is available to professional golfers on the PGA Tour™ as described above.

One of these is called SkyCaddie™, which is a handheld rangefinder that uses a powerful microprocessor, Global Positioning System (GPS), and satellite-based accuracy enhancement technology. The SkyCaddie™ automatically calculates, as you move, distances to up to forty targets per hole simultaneously in less than a second.

With a SkyPlayer™ membership, the golfer can choose from thousands of available SkyCourses™ from the SkyCaddie™ website to download to their SkyCaddie™. Similar to the ShotLink™ system described above, each downloaded course was mapped. Using GPS devices, different layers and elevations were recorded to denote the greens (front, center and back), fairways, bunkers, water, rough, trees and other course elements. If one wished to play non-mapped courses the golfer can record the front, center, and back of each green on such courses using the built-in SkyCourse™ Setup module.

A Golfer playing a round, starting on the first tee, would check the SkyCaddie™ to determine how far he was from the green and to check the terrain for hazards to avoid and safe areas to target his ball. The Golfer could then mark his location by pressing a button on the SkyCaddie, and then take his shot. When the Golfer reached his ball; he/she would already have the distance to the green and other mapped targets. At that point the ball location could be marked again and the display would show the distance the ball traveled with the previous shot. The green or an intermediate target could be selected and the next shot could be taken. The Golfer can continue to use the SkyCaddie™ in this way until the ball is holed and he/she moves on to the next hole. Note that the ranges are also mapped and can be used for practice.

The SkyCaddie™ also uses a very sophisticated tech system but has some shortcomings that can be improved. The golfer must take action to mark the ball to obtain distance information on each shot. The system does not capture, analyze, score, archive, track or communicate real-time relevant golf data. It does compute distance if the ball is marked but does not save the data.

Thus there is a need for a machine and method for automatically sensing the starting point and the ending point for each shot and that also provides real-time relevant golf data specific to the average golfer when practicing, taking lessons or playing a recreational round of golf.

Another machine in this category is called RadarGolf™, which uses radar technology to track and located a recreational golf ball. RadarGolf's Ball Positioning System™ technology helps you locate your golf ball quickly! Save time, penalty strokes and reduce the frustration of searching for golf balls.

The RadarGolf System™, using Ball Positioning System™ (BPS™) technology, consists of three main components. The handheld, Shield-It pouch and ball work together to save you strokes, time, and frustration. The ball contains a tiny chip. When it is struck and the golfer reaches the vicinity of where the golf ball "came down" but cannot locate the exact position of the ball, the handheld machine can be used to locate the ball. BPS™ technology uses advanced electronics to enable the handheld to transmit a specific radio frequency (RF) signal. When this signal reaches a RadarGolf- Ball™, the ball returns a separate specific RF signal. The handheld receiver is tuned to "listen" for the signal from the ball. An LCD provides visual feedback and an audio tone allows you to hone in on your lost ball. You will receive stronger feedback as you get closer to your ball. The Shield-It pouch is used to hold the extra balls not in play (i.e. shield them) so that they will not give false readings to the handheld.

This system does provide some cost effective features for the average golfer that the Tour Golfer has through its spotters and volunteers operating sophisticated laser devices that track ball fight and final location. However there are a number of drawbacks of this system as well. The RadarGolf System™ does not capture, analyze, score, archive, track or communicate real-time relevant golf data. It does locate some lost balls but only when the golfer reaches the vicinity (i.e. within range of 30-100 feet, depending on the terrain) of where the ball came to rest.

Thus there is a need for a machine and method for automatically locating the golf ball after each shot and that also provides real-time relevant golf data specific to the average golfer when practicing, taking lessons or playing a recreational round of golf.

Another machine that falls into the second category is the eCaddy™. That is, this machine together with its software offers a solution to a narrow segment of the spectrum of what is available to professional golfers on the PGA Tour™ as described above. Its focus is on measurements. The eCaddy™ is a digital scorecard that resembles a real scorecard. The top line (Title Field) shows the game and course numbers with the scoring method. The next 3 lines (Course Field) show the Hole Numbers, Pars and Hole Handicaps. The next 4 lines (Player field) show the four players' scores. The only difference from the paper card is that eCaddy shows 3 holes at a time while a paper card shows 9.

The eCaddy™ provides some of the data needed for analysis, as well as some historical information. It handles up to 4 players, 20 rounds of games, 10 courses. It provides totals for Current, Front, Back, Gross and Net. The shot breakdowns are Full Swing, Partial Swing and Putts. It keeps track of Driver Accuracy (Fairway, Left and Right Rough) as well as Sand Saves. After a round, one can interface the eCaddy™ with a PC using the eCaddyLyzer™ and do analysis such as: Handicap Index based on USGA rules, hole score breakdown, shot breakdown, greens-in-regulation, up and down, driver accuracy, sand saves, etc. The primary drawback of this system is that it is not an automated system and data entry is essentially a manual process. Usually such manual data entry is not practical because of the fast "pace of play" one is required to maintain on most golf courses. Also there are some important data elements that are not available such as distance data on ball striking.

Thus there is a need for a system that automates the data capture, scoring and shot analysis while it also archives, tracks and communicates real-time relevant golf data.

SUMMARY OF THE INVENTION

Given all the advantages that the Personal Caddies, Spotters, Volunteer Laser Operators, etc. bring to the PGA Tour Professional and the inherent limitations of the dispirit machines and methods described above that are available to the average golfer, it is the object of the present invention to provide an apparatus or machine and method that overcome the issues and limitations in the discussion of the prior art.

The present invention comprises an apparatus or machine with a plurality of components and includes the use of an enhanced Global Positioning System (GPS) and a handheld computing device (PDA) for communicating with the GPS. It will further include a full set of enhanced Golf Clubs and associated golf balls, golf shoes and golf gloves (all of which may have at least one microchip, impact sensor, unique identifiers and/or pressure sensor integrated into each one; or their equivalent capability in newer technology such as nanotechnology integrated into reengineered versions of these products). These enhanced golf balls, clubs, shoes and gloves would work passively in concert with the GPS system and PDA to 1) accurately sense when the golf club is picked up; 2) capture the pattern of how the golf club is being gripped in comparison to one of the acceptable grip standards; 3) capture the golfer's setup/swing; 4) sense when a shot/swing is taken; and 5) capture, analyze, score, archive, track and communicate real-time relevant golf data as a caddy would, to the golfer. The enhanced golf balls, clubs, shoes and gloves will be designed to meet or exceed all performance criteria established by the USGA (at least for recreational play and/or as a training aid).

BRIEF DESCRIPTION OF THE DRAWINGS

FIG. 1 shows a perspective view of the key components of the present invention.

DETAILED DESCRIPTION OF THE FIRST EMBODIMENT OF THE INVENTION

Referring to the drawing FIGURE listed above, the first embodiment of the present invention is an apparatus or machine comprising components which collectively work together to capture, analyze, score, archive, track and communicate real-time relevant golf data specific to individual golfers for every shot on every hole of an entire recreational golf round. The first embodiment of the apparatus or machine of the present invention will be described initially and then the method of using the apparatus will be described.

The golfer 10 is assumed to be using the apparatus or machine of the present invention with a plurality of components (including enhanced golfing equipment such as a set of Golf Clubs 50, at least one golf ball 60, golf glove 70 and golfing shoes 80) shown in the perspective illustration of FIG. 1 and is comprised of the use of:

- PDA inter-component communications means to include enhanced golfing equipment (with integrated sensors and computing capability), an enhanced Global Positioning System (GPS) 20, and a handheld computing device (PDA) 40 for communicating between the PDA 40 and GPS 20 as well as between PDA 40 and the enhanced golfing equipment;
- PDA mapped golf course access means to include handheld PDA 40, operating system and software for accessing, selecting and downloading chosen mapped golf course(s) 30 from a wide listing of mapped golf courses 30, as well as uploading maps of new golf courses;
- PDA data processing means to include handheld PDA 40, operating system and software to capture, analyze, score, archive, track and communicate real-time relevant golf data specific to individual golfers.

The full set of enhanced Golf Clubs 50 (USGA rules—containing 14 golf clubs) and associated golf balls 60, golf shoes 80 and golf gloves 70 may have at least one microchip, impact sensor, unique identifiers and/or pressure sensor integrated into each one; or their equivalent capability in newer technology such as nanotechnology integrated into reengineered versions of these products. These enhanced golf balls 60, clubs 50, shoes 80 and gloves 70 would work passively in concert with the GPS system 20 and PDA 40 to 1) accurately sense when the golf club 50 is picked up; 2) capture the pattern of how the golf club 50 is being gripped in comparison to one of the acceptable grip standards such as the Verdon Overlap grip, the interlocking grip, the Ten Finger grip or a golfer's 10 own predefined grip; 3) capture the golfer's 10 setup/swing such as body alignment, foot position, ball position, balance and posture; 4) sense when a shot/swing is taken; and 5) capture, analyze, score, archive, track and communicate real-time relevant golf data as a caddy would, to the golfer 10. The enhanced golf balls 60, clubs 50, shoes 80 and gloves 70 will be designed to meet or exceed all performance criteria established by the USGA (at least for recreational play and/or as a training aid).

The enhancements to the golf ball 60 will be made deep in its core and will be miniaturized (or use nanotechnology, for example using nanochips which could store trillions of bits of information in a very small area) so as not to affect the dynamics of the golf ball 60. The enhancements will be designed to withstand the forces exerted on them during normal play of golf rounds and would be expected to last as long as a typical recreational golf ball 60. One of the purposes of the enhanced golf ball 60 will be to work in concert with the PDA 40 and GPS 20 to capture and record real-time golf ball 60 information when struck; including but not limited to 1) golf ball 60 dynamics such as spin; 2) starting and ending location, 3) distance and direction traveled; 4) distance to the pin; and 5) distance to mapped hazards.

The enhancements to the Golf Shoes 80 will allow the system to capture (among other things) the direction and amount of weight shift of the golfer 10 from one foot to the other throughout the golf swing.

Body sensors (not shown) could also be integrated into the apparatus for use during practice and training sessions.

The specially designed and programmed handheld PDA 40 will make use of existing operating systems and software (where available and with applicable modifications) to capture, analyze, score, archive, track and communicate real-time relevant golf data specific to individual golfers 10. The PDA 40 will also make use of existing GPS 20 mapped golf courses 30. With appropriate membership, the golfer 10 can choose from thousands of available Golf Courses 30 on the internet to download chosen courses to their handheld PDA 40. Similar to the ShotLink™ system described above, each downloaded course is mapped. Using GPS 20 devices, different layers and elevations were recorded to denote the greens (front, center and back), fairways, bunkers, water, rough, trees and other course elements. If one wishes to play non-mapped courses the golfer 10 can record similar information on such courses into their handheld PDA 40.

The Invention will further comprise the ability to link to a PC or other computer equipment for uploading and downloading information for analysis, review and study.

That completes the description of the major components of the first embodiment of the invention. Initially, for simplicity assume that there is only a single player for the round. Now attention will be focused on the method of using the first embodiment of the present invention during a round of golf at a GPS mapped golf course. It consists of three major steps: the first major step 1) is to prepare the PDA (preferably prior to arriving at the Golf Course) by downloading the applicable GPS mapped course information from the internet, provide information on type of play (e.g. stroke play vs. match play, set PDA in "caddy inform mode" including displayed and/or verbal advice vs. "record mode only", "training mode" or "player performance and analysis mode"), ensure that the appropriate player information has been identified to the PDA (i.e. clubs, balls, gloves and shoes uniquely tied to each player), then upon arriving at the $1^{st}$ tee for the round, ensure that the PDA is on and operational with the starting hole shown on the PDA.

Continuing with the method of using the first embodiment the second major step: 2) is for the player to check the PDA screen for the characteristics of the entire hole including hazards, distances to fairway and greens or other strategic points, etc., then after deciding on a plan of approach for the hole, "tee off"; the system will automatically detect the club used once the golfer selects the club by griping its handle and it will record the starting ball location and dynamically capture key data relevant to the golfer's tee shot such as club used, club head speed at impact, ball spin, distance and direction of ball, and its location after it comes to rest. If the ball lands in an inaccessible location, the PDA can inform him of that and suggest a plan of approach (as his caddy) for the next shot consistent with the USGA rules, if the player has selected verbal and/or display "caddy inform mode". If the ball is in a hazard area or out of bounds area that is so noted for scoring and to prevent the player from making a mistake by selecting an illegal drop (like any good caddy would do). If the player selected "record mode only", the system (i.e. the PDA in conjunction with GPS) would remain silent but note any mistakes and assess a proper penalty (based on USGA rules) if the player mistakenly drops his ball in the wrong place for his next shot. Whether the ball from the previous shot was inaccessible or not, the location for the next shot would be determined. The player would then proceed to the location where the ball came to rest or the correct location for his next shot (if he has to drop a ball) and check the PDA screen for the characteristics of the hole from the new position of the ball, looking for hazards, distances to safe landing locations for his $2^{nd}$ shot or accessing whether he should try shooting for the green; upon deciding on a plan of approach for the $2^{nd}$ shot the player selects a club by griping its handle, set up for the shot and takes it. The player continues in this way until he reaches the green. This leads to the third and last major step.

Continuing with the method of using the first embodiment, the third major step: 3) is to closeout the hole and ensure that scores are accounted for all players as they "hole-out" their balls at each hole. Also all strokes are reconciled and recorded. The system will know that the player is now on the green because it knows the boundaries of the green. The system then tallies putting strokes until the player holes the ball. As a result of the fact that the system knows the contour of the topography around the greens and the golf clubs each player used, it can keep an accurate count of sand saves, pitches and chips as well as putts on the green. Scoring is automatic because the PDA in communication with GPS will use such known information as course played, hole pars, hole handicaps, player handicaps combined with the results of each shot taken (including penalty strokes, if any) to determine the score for the hole. At any point during the course of play, the player can make manual corrections to the scoring and other information in the PDA, but the system can keep track of corrections as an audit.

When the $1^{st}$ hole is completed, the player goes on to the $2^{nd}$ hole and repeats the 3 steps for the $2^{nd}$ hole and each subsequent hole through completion of the 9th hole, whereupon the system will tally the front 9 and the player can move on to the $1^{st}$ hole on the back 9. The entire 3 step process is then repeated for each hole in the back 9. Upon completion of the $18^{th}$ hole, the system tallies the back 9, the Gross and Net score for the player. In this way every shot on every hole of the entire recreational golf round is captured, scored and archived. The information is also available for review using the PDA. It can also be downloaded to a PC for analysis and for training.

Now we can remove the assumption that there is only one player. If we had a foursome and each player had his own PDA and enhanced golf equipment, then the process would be essentially the same because each player would simply use the system as described for a single player and the system would accommodate all four players. The same would be true even for an entire tournament of players as long as each player had their own PDA and enhanced golf equipment. That completes the detail description of the first embodiment.

What is claimed is:

1. An apparatus for caddying and training golfer(s), the apparatus comprising:

a. a plurality of enhanced components that work in concert as an automated system to capture, analyze, score, archive, track and communicate real-time relevant golf data specific to individual golfers; said enhanced components further comprising:

i. a Global Positioning System (GPS);

ii. a plurality of mapped golf courses;

iii. a plurality of enhanced golfing equipment; said enhanced golfing equipment comprising (1) a plurality of microchips, nanochips, impact sensors, unique identifiers, and pressure sensors for integration into said enhanced golfing equipment;

iv. a handheld computing device (PDA); said PDA comprising:

(1) operating system;

(2) plurality of application software; said application software includes:

(a) a virtual caddy for communicating advice, suggestions and counsel to the golfer just as a professional caddy would do for his PGA Tour Professional;

(b) a component ID software application for identifying said enhanced golfing equipment of the golfer to the PDA;

(3) plurality of golf data; said golf data includes:

(a) component golf data for establishing the key dynamic characteristics of said enhanced components;

(b) global positioning golf data for locating each of said enhanced components;

whereby, given the data captured and processed by the enhanced components and further processed within the PDA, the typical advice offered by a caddy or instructor such as shot strategy and club selection is communicated to the golfer as needed during a round of golf, training or practice via the virtual caddy application software of the PDA.

2. The apparatus of claim 1, said enhanced components further comprising:

a. intra-component computing circuits for capturing and processing said component golf data within said enhanced components; said intra-component computing circuits comprising integrating chip technology in said enhanced components;

b. GPS inter-component communications circuits for communicating said global positioning golf data between said enhanced golfing equipment and said GPS;

c. inter-component communications circuits for communicating said golf data between said enhanced components including said PDA for further processing and communication by said virtual caddy to the golfer;

d. at least one golf club;

e. at least one golf ball.

3. The apparatus of claim 1, said PDA further comprising:

a. PDA inter-component communications means for communicating between said PDA and said GPS, and between said PDA and said enhanced golfing equipment;

b. PDA mapped golf course access means for accessing, selecting, downloading and uploading said mapped golf course(s); and c. PDA data processing means for processing said global positioning golf data from said GPS and said component golf data from said enhanced components to work in concert as a system for capturing, analyzing, scoring, archiving, tracking and communicating real-time relevant golf data specific to individual golfers.

4. The apparatus of claim 2, said golf club comprising:

a. golf club grip sensors for sensing when the golf club is gripped; said golf grip sensors include integrating said pressure sensors in said golf club;

b. golf club impact sensors for sensing when a shot is taken; said golf club impact sensors include integrating said impact sensors in said golf club;

c. golf club ID sensors for uniquely identifying each said golf club so that it can be associated with the golfer; said golf club ID sensors comprises integrating said unique identifiers in said golf club.

5. The apparatus of claim 4, said golf club further comprising:

a. intra-club computing circuits for providing computing inside of said golf club, which comprises integrating said intra-component computing circuits in said golf club;

whereby the golf club integrated computing circuits in concert other enhanced golfing equipment provides the processing power to capture, analyze, score, archive, track and communicate real-time relevant golf data specific to individual golfers.

6. The apparatus of claim 2, said golf ball comprising:

a. golf ball impact sensors integrated in said golf ball for sensing when said golf ball is struck with said golf club;

b. golf ball ID sensors for uniquely identifying each said golf ball so that it can be associated with the golfer; said golf ball ID sensors comprises integrating said unique identifiers in said golf ball(s);

whereby the data from the golf ball sensors in concert with data from the other enhanced golfing equipment provides the data input to the application software to capture, analyze, score, archive, track and communicate real-time relevant golf data specific to individual golfers.

7. The apparatus of claim 6, said golf ball further comprising:

a. intra-ball computing circuits which comprises integrating said intra-component computing circuits in said golf ball;

whereby the golf ball sensors in concert with the chip technology provides the processing power to capture, analyze, archive, track and communicate real-time relevant golf ball dynamics specific to individual golfers.

8. The apparatus of claim 2, said golfing equipment further comprising:

a. at least one golf glove, wherein said golf glove is comprised of:

i. golf glove grip sensors for sensing when the golfer's grip conforms to one of the predefined grip standards selected from the group consisting of the Verdon Overlap grip, the Interlocking grip, the Ten Finger grip, and the Custom grip during the setup for the golf shot;

ii. golf glove ID sensors for uniquely identifying each said golf glove so that it can be associated with the golfer; said golf glove sensors comprises integrating said unique identifiers in said golf glove;

iii. intra-glove computing circuits, which comprises integrating said intra-component computing circuits in said golf glove;

whereby the golf glove grip sensors in concert with data from the other enhanced components provides the input data and the chip technology provides the processing power to capture, analyze, archive, track and communicate real-time relevant golf glove grip data specific to the golfer.

9. The apparatus of claim 2, said golfing equipment further comprising a. a pair of golf shoes wherein said pair of golf shoes is comprised of:

i. golf shoe(s) sensors for capturing the golfer's setup including foot position and balance;

ii. golf shoe ID sensors for uniquely identifying each said golf shoe so that it can be associated with the golfer; said golf shoe ID sensors comprises integrating said unique identifiers in said golf shoe(s);

iii. intra-shoe computing circuits for determining topography from said foot position of each said golf shoe in the areas where the golfer walks and pauses while evaluating his putt line; said intra-shoe computing circuits comprises integrating said intra-component computing circuits in said golf shoes;

whereby the golf shoe(s) sensors in concert with data from the other enhanced components provides the input data and the chip technology provides the processing power to capture, analyze, archive, track and communicate real-time relevant putt line data specific to the golfer.

10. A method for caddying and training golfers, the method comprising:

a. providing an apparatus for caddying and training golfers comprising a plurality of enhanced components that work in concert as an automated system, the apparatus further comprising:

i. a Global Positioning System (GPS);

ii. a plurality of GPS mapped golf courses;

iii. a plurality of enhanced golfing equipment comprising a plurality of golf clubs including a putter, a pair of golf shoes, a golf glove, a golf ball(s); the enhanced golfing equipment further comprising a plurality of computing circuits, a plurality of sensors;

iv. a handheld computing device (PDA) further comprising a plurality of golf data, a plurality of application software including a virtual caddy, a component ID application;

b. initializing the PDA software (virtual caddy) at least once, comprising:

i. downloading the applicable GPS mapped course information from the internet; and ii. identifying the appropriate player information to the component ID application and in turn the virtual caddy by tying each uniquely identified piece of the enhanced golfing equipment to its golfer owner;

c. interacting with the virtual caddy during the golf round, comprising:

i. adjusting the virtual caddy to reflect actual conditions of play for a current hole;

ii. consulting the virtual caddy for the characteristics of the current hole including hazards, distances to fairway, greens and other strategic points;

iii. consulting the virtual caddy for suggestions for a plan of approach for the current hole;

iv. deciding on the plan of approach for a plurality of shots for the current hole;

d. taking the shot on the current hole;

e. assessing the results of the shot on the current hole with the virtual caddy;

f. repeating the applicable steps above on the current hole for each subsequent shot until the golf ball is holed-out;

g. synchronizing a score card with the virtual caddy; and h. repeating the applicable steps above on each subsequent hole until the golf round is complete.

11. A method as recited in claim 10, wherein for non-putting shot(s), the taking the shot step further comprising:

a. selecting the golf club for the shot; wherein triggering collection of the golf club data and the start of a pre-shot setup routine;

b. gripping the golf club; wherein triggering the sensors in the enhanced golf equipment relative to the virtual caddy's grip standards;

c. capturing the pre-shot setup routine; wherein triggering the sensors and the computing circuits in the enhanced golfing equipment; and d. capturing the shot (swing) wherein triggering the sensors and the computing circuits in the golf club and the golf ball.

12. A method as recited in claim 10, wherein for putting shots, the taking the shot step further comprising:

a. selecting the putter for the shot; wherein triggering collection of putter club data and the start of a typical pre-putting setup routine that requires walking along an initial putt line;

b. using the typical pre-putting setup routine that requires walking along the initial putt line, wherein triggering the sensors and the computing circuits in the enhanced golfing equipment;

c. creating a local topography survey including slopes and slope directions of the greens around and between the golf ball and the current hole to identify the best alternative putting paths through the execution of the typical pre-putting setup routine;

d. gripping the putter; wherein triggering the sensors in the enhanced golfing equipment relative to the virtual caddy's grip standards; and e. capturing the shot (putt) wherein triggering the sensors and computing circuits in the putter and the golf ball;

Whereby the typical pre-putting setup routine that requires walking along the initial putt line once the initial putt line is selected, triggers the sensors and the computing circuits integrated in the enhanced golfing equipment to work together as a system to identify the best alternative putt path(s) that offer the golfer, given the golfer's recent historical putting performance, the best chance of sinking the putt.

13. A method as recited in claim 12, wherein the creating a local topography survey step further comprising:

a. reviewing the relative position of the golf ball to the current hole as the golfer approaches the green for his putt;

b. examining the line from the golf ball to the current hole and if necessary, from the opposite direction, from the current hole to the golf ball to determine a low side where the terrain is sloping downward to make it easier for the golfer standing at the low side, to look up the slope towards the golf ball and the current hole to identify the initial putt line from the golf ball to the current hole;

c. lining up the golfer's position, with the golf ball position closest to the golfer and the current hole position furthest from the golfer in a relatively straight line and compare to the initial putt line;

d. pausing at sufficient intervals, a few feet behind the golf ball to closely examine the topography including the slopes and slope directions around the greens from a few feet behind the golf ball to the golf ball;

e. pausing at sufficient intervals, along the initial putt line between the golf ball and the current hole to examine the changing topography of the greens;

f. pausing at sufficient intervals to examine the topography of the greens from a few feet beyond the current hole to the current hole, opposite the side the golf ball is on;

g. pausing, if it is still not clear on how the putt will break, at sufficient intervals to examine the initial put line from the opposite side, the changing topography as the golfer completes a slow circle from a few feet beyond the current hole, and continues in the same direction around the current hole, to the beginning point a few feet behind the golf ball;

Whereby the walking and pausing inherent to the typical pre-putting set-up routine triggers the sensors of the golf shoes to collect the data input which in turn is used by the computing circuits integrated into the enhanced golfing equipment including the PDA and the golf shoes to develop the slopes and slope directions of the greens at each pause.

14. A method as recited in claim 13, wherein the pausing steps further comprising:

a. capturing each golf shoe position and balance data independent of the other golf shoe position and balance data and relative to each other during each pause;

b. calculating the slopes and slope directions of the greens around each golf shoe independently as well as the slopes and slope directions of the greens between the golf shoes at each pause to form a plurality of slope data;

c. communicating the plurality of slope data to the virtual caddy for further analysis;

d. stitching the plurality of slope data together to form a topographical map of the greens around and between the golf ball and the current hole so that a plurality of the best alternative putting paths could be calculated;

e. assessing the virtual caddy's recommendation of the best alternative putting path(s);

Whereby the plurality of slope data triggered by the typical pre-putting setup routine is communicated to the virtual caddy which subsequently stitches the plurality of slope data together to produces a topographical survey of the greens, around and between the golf ball and the current hole; the virtual caddy uses the topographical survey to identify the best alternative putt path(s) that offer the golfer, given the golfer's recent historical putting performance, the best chance of sinking the putt.

15. A method as recited in claim 14, wherein the assessing the virtual caddy's recommendation of the best alternative putting path(s) step further comprising:

a. reviewing the virtual caddy's recommended list of the best alternative putting path(s) in order of most likely to least likely to succeed;

b. reviewing the virtual caddy's assessment of the golfer's historical putting record at similar distances and topography between the golf ball and the current hole;

c. deciding on the best putting path in light of the facts;

Whereby continuing with the typical pre-putting setup routine, the golfer compares the initial putt line identified to the alternatives recommended by the virtual caddy and decides on the putt line to use in view of the golfer's historical putting record.

16. A method as recited in claim 10, wherein the assessing the results of the shot step further comprising:

a. recording a plurality of golf ball dynamics; and b. assessing the virtual caddy's revised characteristics of the current hole for the plurality of shot(s) from a new golf ball location, if the golf ball was not holed-out.

17. a method as recited in claim 10, wherein the synchronizing the score card with the virtual caddy step further comprising:

a. ensuring that all strokes are tallied on every hole from tee to green, including tee shots, fairway shots, bunker shots, errant shots, pitches, sand-shots, chips, putts and extra strokes for penalties; and b. ensuring that all relevant golf data is captured, scored and archived.

* * * * *